US005549540A

United States Patent [19]

Moore et al.

[11] Patent Number: 5,549,540

[45] Date of Patent: Aug. 27, 1996

[54] CENTRIFUGE INSERT FOR SUPPORT OF FLUID CONTAINING BAGS

[75] Inventors: Glenn Moore, Nivelles, Belgium; Caryl Ellis, Norfolk, England

[73] Assignee: Baxter International Inc., Deerfield, Ill.

[21] Appl. No.: 322,212

[22] Filed: Oct. 13, 1994

[51] Int. Cl.[6] ..... B04B 5/02; B04B 15/00

[52] U.S. Cl. ..... 494/20; 494/21; 248/100

[58] Field of Search ..... 494/16, 20, 21, 494/33, 45, 85; 210/512.1, 513, 361, 781, 782, 787; 248/97, 100

[56] References Cited

U.S. PATENT DOCUMENTS

| | | | |
|---|---|---|---|
| 3,674,197 | 7/1972 | Mitchell et al. | 494/21 X |
| 4,266,717 | 5/1981 | Jennings et al. . | |
| 4,439,177 | 3/1984 | Conway | 494/20 |
| 4,482,342 | 11/1984 | Lueptow et al. . | |
| 4,543,084 | 9/1985 | Bailey | 494/20 |
| 4,753,739 | 6/1988 | Noble | 494/20 X |
| 4,892,668 | 1/1990 | Harmony et al. | 210/787 X |
| 4,909,949 | 3/1990 | Harmony et al. | 494/20 X |
| 5,158,749 | 10/1992 | Eberle | 494/20 X |

FOREIGN PATENT DOCUMENTS

| | | | |
|---|---|---|---|
| 2058578 | 5/1971 | France | 494/16 |

*Primary Examiner*—Charles E. Cooley
*Attorney, Agent, or Firm*—Bradford R. L. Price; Joseph B. Barrett; Allan O. Maki

[57] ABSTRACT

An insert nestingly receivable within a centrifuge cup to support a pair of fluid containing bags therein is formed from a pair of concave shapes having an upper end and a lower end and which are centrally adhered together in back-to-back relationship. The shapes together with an interior surface of the centrifuge cup together form a pair of elliptically shaped chambers for supporting a pair of the bags within the cup. A pair of pins extend through the concave shapes and extend outwardly therefrom. The bags each are provided with a pair of spaced-apart holes to receive the pins, thereby supporting the bags within the elliptically shaped chambers. Preferably a block is fitted between the adhered together surfaces of the shapes at each lateral edge at the lower ends thereof. These blocks preferably extend laterally outwardly beyond the lateral extremities of the shapes, and the edges of the concave shapes and the blocks are rounded to thereby be nestingly receivable in the interior of the cup.

5 Claims, 2 Drawing Sheets

Fig. 3
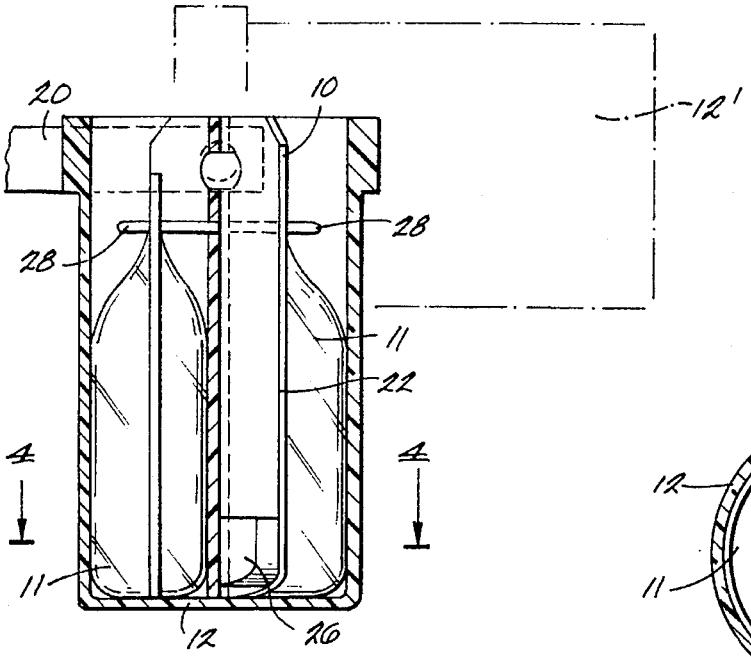
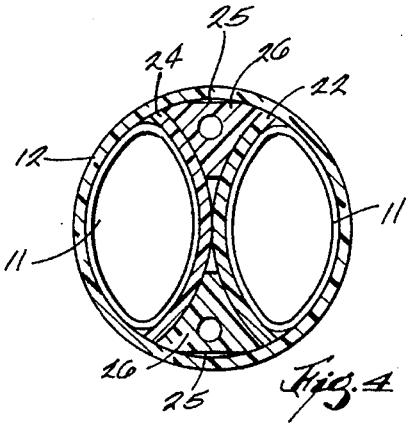
Fig. 4
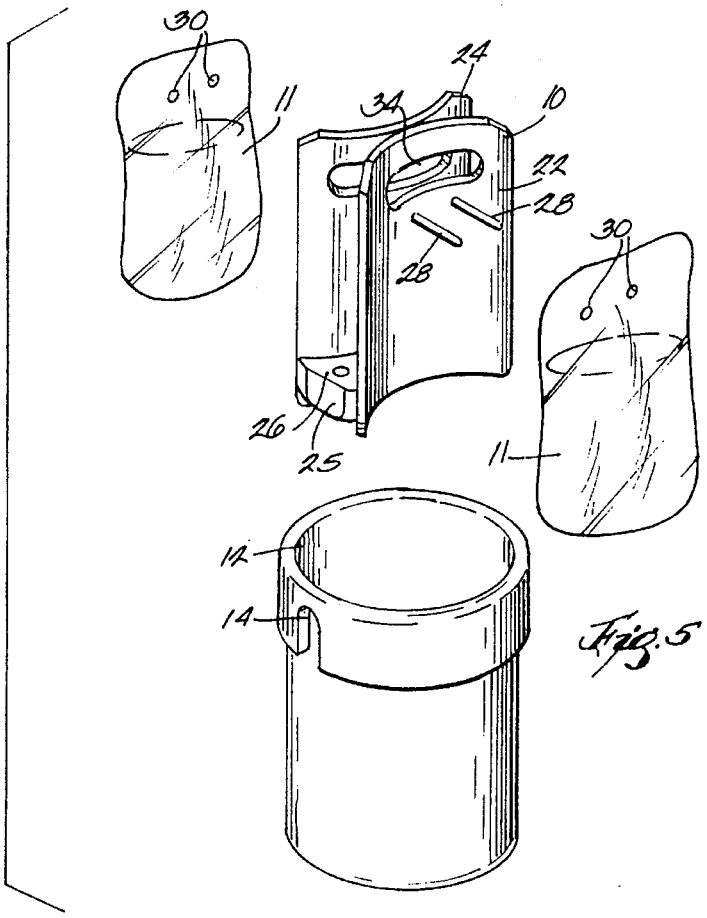
Fig. 5

CENTRIFUGE INSERT FOR SUPPORT OF FLUID CONTAINING BAGS

FIELD OF THE INVENTION

The invention relates to systems for supporting blood-containing bags during centrifugation. More specifically, the invention relates to an improved insert for supporting a pair of blood bags within a centrifuge cup.

BACKGROUND OF THE INVENTION

Blood bags are typically placed in a centrifuge cup when centrifuged in order to separate blood into its various constituents within the blood bag. If the blood bag is not properly supported while being centrifuged, a certain percentage of the bags will suffer from buckling, which interferes with the blood constituent separation, or from splitting which results in the total loss of the blood and presents a need for unwanted clean-up efforts. Thus, a need has existed for improved centrifuge insert devices for support of bags.

Various devices have been proposed in the past, for example in U.S. Pat. No. 4,909,949, a bridge is attached to the upper edge of the centrifuge cup in order to suspend a blood collection bag in within the cup together with an expresser for expressing centrifuged blood from the bag. Another form of support is shown in U.S. Pat. No. 4,543,084 wherein a supporting structure was provided in order to hold the bag in an upstanding position to prevent buckling of the bag that would tend to trap blood within the folds of the bag thus hindering the separation process. Yet another device for holding the ports at the top of a blood bag is shown in U.S. Pat. No. 4,753,739. Even in light of these various devices, a need has continued to exist for improved blood bag supporting inserts for centrifuge cups.

SUMMARY OF THE INVENTION

It is a principal object of the present invention to provide an improved blood bag supporting structure for insertion into a centrifuge cup. In accordance with an important aspect of the invention, the blood bags are supported in an upright position so that buckling or folding of the bags is prevented. In accordance with a further aspect of the invention, the blood bags are cradled within a cavity defined by the insert and the adjoining interior wall of the centrifuge cup.

Briefly, the invention provides an insert nestingly receivable within a centrifuge cup to support a pair of fluid containing bags therein. The insert is formed from a pair of concave shapes having an upper end and a lower end and which are centrally adhered together in back-to-back relationship. The shapes together with an interior surface of the centrifuge cup together form a pair of elliptically shaped chambers for supporting a pair of the bags within the cup. A pair of pins extend through the concave shapes and extend outwardly therefrom. The bags each are provided with a pair of spaced-apart holes to receive the pins, thereby supporting the bags within the elliptically shaped chambers. Preferably a block is fitted between the adhered together surfaces of the shapes at each lateral edge at the lower ends thereof. These blocks preferably extend laterally outwardly beyond the lateral extremities of the shapes, and the edges of the concave shapes and the blocks are rounded to thereby be nestingly receivable in the interior of the cup.

Further objects and advantages of the invention will become apparent from the accompanying detailed description, claims and drawings.

BRIEF DESCRIPTION OF THE DRAWINGS

FIG. 3 is a sectional view taken along line 3—3 of FIG. 2;

FIG. 4 is a sectional view taken along line 4—4 of FIG. 3; and

FIG. 5 is a perspective view showing a centrifuge cup, blood bags and insert in disassembled relationship for clarity.

DETAILED DESCRIPTION OF A PREFERRED EMBODIMENT

Figure 2:
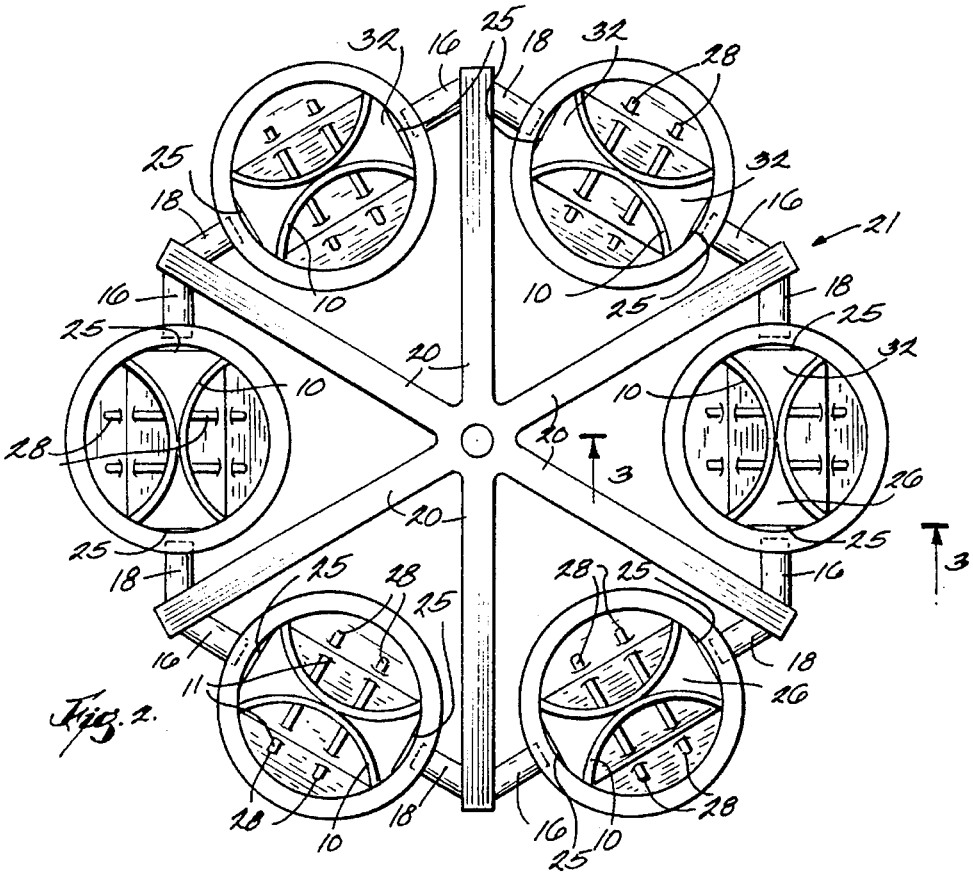
FIG. 2 is a top view of a centrifuge in stationary position showing a plurality of centrifuge cups containing inserts in accordance with the present invention.
Figure 1:
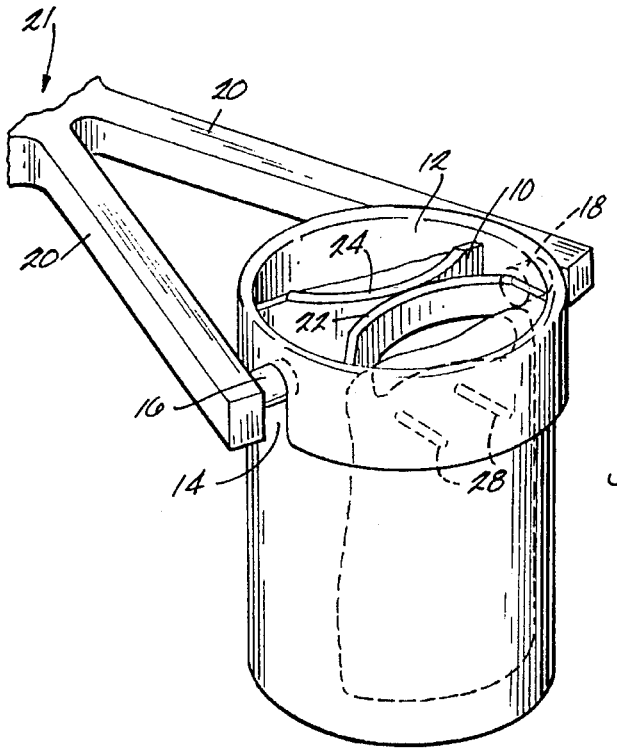
FIG. 1 is a perspective view of a centrifuge cup with an insert containing an insert of the present invention and supporting blood bags therein and suspended from a centrifuge yolk, illustrated fragmentarily.

Referring more specifically to the drawings, an insert according to the present invention is indicated generally by numeral 10. Each insert 10 is adapted to fit within the open end of a centrifuge cup 12. The upper end of each cup 12 is provided with a collar having insets 14 which are diametrically opposed from each other. Insets 14 are adapted to support cup 12 on studs 16 and 18 which are supported on arms 20 of a centrifuge yolk 21. A pair of blood bags 11 is supported within each centrifuge cup 12.

Insert 10 is formed from two concavely shaped sections 22 and 24 which are joined together at their backs. Suitably shaped blocks 26 are provided at the bottom of each of the sections 22 and 24 to provide stability to the insert. The blocks 26 preferably extend outwardly from the lateral edges of sections 22 and 24. These lateral edges and the outer perimeters of blocks 26 are rounded at edge sections 25 which adjoin the edges of sections 22 and 24 to form a surface that is nestingly receivable in the interior of a cup 12. As seen in FIGS. 4 and 5, while perimeter segments 25 are rounded they may be connected by a central linear section disposed between the rounded portions.

A pair of pins 28 extends outwardly from the surface of each of concave sections 22 and 24. Pins 28 are spaced to receive a pair of holes 30 formed in the upper end of each blood bag 11. Additionally, pins 28 serve to anchor sections 22 and 24 together. It is preferred that sections 22 and 24, pins 28 and blocks 26 all be adhered together with an adhesive to form a unitary composite structure. It should be noted that the lateral sides of insert sections 22 and 24 form (together with the interior surfaces of cup 12) an open-ended chamber 32 within which a rolled up empty blood bag can conveniently be stored for later use. Openings 34 are provided through each of sections 22 and 24 to provide a means for conveniently grasping and lifting the insert 10.

It will be apparent that the blood bags 11 are confined within a somewhat elliptically shaped chamber on each side of the insert as best seen in FIG. 4. Thus, the blood bags are supported in cocoon-like fashion representing a departure and improvement over the prior art devices and, thus, minimizing rupturing of the bags.

While preferred embodiments of the invention have described, it will be clear to those skilled in the art that various modifications and adaptations of the invention can be made. Thus, the invention should not be as limited to the specific embodiments but construed as including the materials defined by the claims and equivalents thereto.

What is claimed is:

1. An insert nestingly receivable within a centrifuge cup to support a pair of fluid containing bags therein comprising:

a pair of concave shapes, each having a front surface and a back surface, each of said shapes having an upper end and a lower end and a pair of opposed lateral edges connecting said upper and lower ends, said pair of shapes being centrally attached together in back-to-back relationship, said shapes together with an interior surface of said centrifuge cup together adapted to form a pair of elliptically shaped chambers for supporting said pair of bags within said cup, at least one pin extending through said concave shapes and extending outwardly therefrom, said at least one pin being adapted to support one of said baas within each of said elliptically shaped chambers.

2. An insert according to claim 1 wherein a pair of blocks is fitted between said lateral edges of said shapes, a first one of the blocks of said pair being at an opposite side of the area of central attachment of said concave shapes from the other block of said pair, at the lower ends of said concave shades.

3. An insert according to claim 2 wherein said blocks extend laterally outwardly beyond the lateral edges of said shapes, and said lateral edges of said shapes and portions of said blocks adjoining said lateral edges are rounded to thereby be nestingly receivable in the interior of said cup.

4. In combination with a swinging bucket adapted to be suspended on a rotor rotatable on a spin axis in a centrifuge, a bucket insert adapted to support a plurality of liquid containing bags within said bucket, wherein said insert includes a plurality of outwardly concave shapes, each having a front surface and a back surface, each of said shapes having an upper end and a lower end and being affixed in back to back relationship, said shapes, together with an interior surface of said swinging bucket together forming a plurality of elliptically shaped chambers for supporting said bags within said bucket, at least one pin extending outwardly from each of said concave shapes being adapted to form a support for receiving and supporting one of said bags thereon.

5. An insert nestingly receivable within a centrifuge bucket to support a plurality of fluid containing bags therein comprising a plurality of concave shapes, each having a front surface and a back surface, each of said shapes having an upper end and a lower end and being adhered together in back to back relationship, said shapes together with an interior surface of said centrifuge bucket together adapted to form a plurality of elliptically shaped chambers for supporting said fluid containing bags within said bucket, at least one pin extending outwardly from each of said concave shapes near the upper end thereof being adapted to form a support for one of said fluid containing bags within one of said elliptically shaped chambers.

* * * * *

UNITED STATES PATENT AND TRADEMARK OFFICE

CERTIFICATE OF CORRECTION

PATENT NO. : 5,549,540
DATED : August 27, 1996
INVENTOR(S) : Moore et al

It is certified that error appears in the above-identified patent and that said Letters Patent is hereby corrected as shown below:

Column 3, Line 15, Delete "baas" and substitute --- bags ---

Signed and Sealed this

Thirty-first Day of March, 1998

*Attest:*

Bruce Lehman

BRUCE LEHMAN

*Attesting Officer*

*Commissioner of Patents and Trademarks*